US011091828B2

(12) United States Patent
Cullivan et al.

(10) Patent No.: US 11,091,828 B2
(45) Date of Patent: Aug. 17, 2021

(54) SYSTEMS FOR REMOVING IMPURITIES FROM GALVANIZING FLUX SOLUTION

(71) Applicant: Beta Control Systems, Incorporated, Beaverton, OR (US)

(72) Inventors: Bryan Murray Cullivan, Beaverton, OR (US); Jared Christopher Cullivan, Beaverton, OR (US)

(73) Assignee: Beta Control Systems, Incorporated, Beaverton, OR (US)

( * ) Notice: Subject to any disclaimer, the term of this patent is extended or adjusted under 35 U.S.C. 154(b) by 8 days.

(21) Appl. No.: 16/397,059

(22) Filed: Apr. 29, 2019

(65) Prior Publication Data

US 2019/0249287 A1 Aug. 15, 2019

Related U.S. Application Data

(63) Continuation of application No. 15/976,866, filed on May 11, 2018, now Pat. No. 10,316,400.

(60) Provisional application No. 62/504,918, filed on May 11, 2017.

(51) Int. Cl.

| | |
|---|---|
| ***C23C 2/30*** | (2006.01) |
| ***C23C 2/00*** | (2006.01) |
| *C23C 18/16* | (2006.01) |

(52) U.S. Cl.

CPC ..... *C23C 2/30* (2013.01); *C23C 2/003* (2013.01); *C23C 18/1617* (2013.01); *C23C 18/1637* (2013.01)

(58) Field of Classification Search

None

See application file for complete search history.

(56) References Cited

U.S. PATENT DOCUMENTS

| | | | |
|---|---|---|---|
| 1,780,323 | A | 11/1930 | Waring |
| 2,012,809 | A | 8/1935 | Derick et al. |
| 2,131,312 | A | 9/1938 | Colton |
| 3,268,388 | A | 8/1966 | Bauman |

(Continued)

FOREIGN PATENT DOCUMENTS

| | | | |
|---|---|---|---|
| EP | 0084478 | A2 | 7/1983 |
| EP | 0112764 | A1 | 7/1984 |
| GB | 191308910 | A | 4/1914 |

OTHER PUBLICATIONS

Qiankun Jing, Xingyu Liu, Jiankang Wen, A novel iron oxidation process in zinc leaching solution by ozone, Jun. 14, 2016, www.researchgate.net.

(Continued)

*Primary Examiner* — Chester T Barry

(57) ABSTRACT

A method for removing soluble ferrous iron from a galvanizing flux solution includes circulating the flux solution through a concentration loop and injecting ozone into the concentration loop, wherein the ozone mixes with the flux solution and reacts with soluble ferrous iron to form insoluble ferric iron in the loop. Flux solution that is substantially free of insoluble ferric iron may be removed from the concentration loop through a filter medium such as a cross-flow microfilter, thereby concentrating the ferric iron in the concentration loop. The ozone may be injected through an eductor that utilizes motive force from a circulation pump, thereby reducing energy consumption and providing rapid mixing and reaction of ozone and ferrous iron.

2 Claims, 3 Drawing Sheets

(56) References Cited

U.S. PATENT DOCUMENTS

| | | | | |
|---|---|---|---|---|
| 6,485,696 | B1 | 11/2002 | Sato et al. | |
| 2002/0192110 | A1* | 12/2002 | Garlick | A61L 2/025 422/37 |
| 2011/0186513 | A1* | 8/2011 | Vuong | C02F 1/28 210/636 |
| 2012/0292259 | A1 | 11/2012 | Marcin | |
| 2013/0140231 | A1* | 6/2013 | Novak | C02F 3/26 210/603 |
| 2013/0140232 | A1* | 6/2013 | Fabiyi | C02F 3/26 210/604 |
| 2014/0158544 | A1 | 6/2014 | Du | |
| 2014/0217019 | A1* | 8/2014 | Mehta | C02F 9/00 210/626 |
| 2015/0164803 | A1 | 6/2015 | Hakata et al. | |

OTHER PUBLICATIONS

Wen Liang, Chaomeng Dai, Xuefei Zhou, Yalei Zhang, Application of Zero-Valent Iron Nanoparticles for the Removal of Aqueous Zinc Ions under Various Experimental Conditions, Jan. 2014, www.plosone.org.

Mark Spencer, The Everyman's Guide to the Miraculous but Misunderstood ORP Sensor, Apr. 18, 2012, www.aquatetrix.com.

Porex Filtration Division_1, Porex® Tubular Membrane Filter (TMF™) Applied in Copper/Nickel Wastewater Treatment System for an Electroplating Industry Park, Jul. 8, 2013, www.porexfiltration.com.

Porex Filtration Division_2, Metal Precipitation & Electroplating Wastewater Treatments, Feb. 27, 2017, www.porexfiltration.com.

Porex Filtration Division_3, Porex® Tubular Membrane Filter™ Modules for Metal Contaminated Wastewater Treatment & Reclamation, Aug. 10, 2011, www.porexfiltration.com.

Porex Filtration Division_4, Porex® Tubular Membrane Filter Modules for Metals Precipitation / Removal, Jun. 6, 2009, www.porexfiltration.com.

Hoffland Environmental, Hydroxide Precipitation, Mar. 5, 2017, http://www.hofflandenv.com/hydroxideprecipitation/.

Water Specialist Technologies, Precipitation by pH, Mar. 5, 2017, http://waterspecialists.biz/wp/?page_id=115.

Tomasz Suponik, Antoni Winiarski, Jacek Szade, Processes of Removing Zinc from Water using Zero-Valent Iron, Oct. 5, 2015, https://www.ncbi.nlm.nih.gov/pmc/articles/PMC4594089/.

Robert O. Hoffland, Joe Portera, Purifying Galvanizing Flux Solution, May 13, 2015, http://infohouse.p2ric.org/ref/25/24739.pdf.

Michigan Deq, Chemical Clarification Precipitation Methods, Jan. 21, 2014, https://www.michigan.gov/documents/deq/wrd-ot-chemical-clarification-metals-precipitation_445210_7.ppt.

Donald L. Stewart, Jr., James C. Daley, Robert L. Stephens, Fourth International Symposium on Recycling of Metals and Engineered Materials, Oct. 22, 2000, The Minerals, Metals & Materials Society.

Mazzei, The Mazzei GDT™ Process . . . Efficient and Effective Contacting, May 2, 2017, http://mazzei.net/gdtprocess/.

Porex (Metals Precipitation I Reduction I Recycle), http://www.porexfiltration.com/applications/tubular-membrane-app/metals-precipitation-reduction-recycle/ , downloaded Dec. 23, 2018 (Year: 2009).

* cited by examiner

SYSTEMS FOR REMOVING IMPURITIES FROM GALVANIZING FLUX SOLUTION

CROSS-REFERENCE TO RELATED APPLICATIONS

This application is a continuation of U.S. patent application Ser. No. 15/976,866 filed May 11, 2018, now U.S. Pat. No. 10,316,400, which claims priority from U.S. Provisional Patent Application Ser. No. 62/504,918 filed May 11, 2017 which is incorporated by reference.

BACKGROUND

Galvanization, or galvanizing, is a common process that has long been used to protect steel parts by applying a protective coating of zinc to the surface of the steel. During the galvanizing process, steel parts are first degreased to remove dirt, oil and organic substances. After degreasing, the parts are rinsed with water and then pickled in a dilute solution of hydrochloric or sulfuric acid to remove iron oxides and mill scale. After rinsing again, the steel parts are dipped in a flux tank containing a solution of zinc chloride and ammonium chloride.

The flux solution is slightly acidic, so it removes any remaining oxidation and creates a protective coating on the steel before it is dipped into a kettle of molten zinc where a final protective layer of zinc forms on the parts.

After multiple uses, the solution in the flux tank becomes unsuitable for further use due to contamination with metals from the steel parts, as well as chemicals that may be carried over from the pickling solution. The most common contaminants are ferrous iron ($Fe+^2$ ions) and sulfates (in galvanizing operations that use sulfuric acid for pickling). Disposal of the contaminated flux as hazardous waste is usually prohibitively expensive. The flux may be neutralized to make it less hazardous, but this creates large volumes of sludge for disposal. Both of these approaches waste large amounts of zinc ammonium chloride salts which are dissolved in the flux solution and are necessary for proper fluxing of parts during the galvanizing process.

Rather than disposing of the contaminated flux solution, another approach is to remove the contaminants so the flux can be reused. A fundamental challenge with this approach is removing dissolved contaminants such as ferrous and sulfate ions while retaining the valuable zinc ammonium chloride which is also dissolved in the flux.

FIG. 1 illustrates a prior art system for removing ferrous iron from a galvanizing flux bath of zinc ammonium chloride. Contaminated solution from the bottom of the flux bath 10 is pumped to a first continuously stirred treatment tank 12 where hydrogen peroxide reacts with the soluble ferrous iron (Fe+2) to form insoluble ferric iron (Fe+3). Ammonium hydroxide is also added to maintain the pH at a level that maximizes precipitation of the iron while minimizing precipitation of the zinc. The treated solution is then transferred to a second continuously stirred treatment tank 14 where a polymer is added to facilitate precipitation of the insoluble ferric iron. The solution is allowed to overflow into a surge tank 16 and is then pumped into a clarifier 18 which is equipped with a tube settler. Supernatant flows back to the flux bath 10 while sludge is compacted in a filter press 20. Filtrate from the filter press flows back to the first treatment tank while compacted solids are sent to a disposal facility.

Although the system of FIG. 1 has been used for decades, it has multiple drawbacks that have become increasingly problematic in recent years. First, hydrogen peroxide is a hazardous chemical to work with. In addition to being highly toxic and corrosive, it can also be explosive. Handling hydrogen peroxide safely requires proper training and safety equipment which add cost, time and complexity to a galvanizing operation. Moreover, even relatively concentrated solutions of hydrogen peroxide (e.g., 35 percent) contain large amounts of water that dilute the chemistry and alter the reactions.

Another problem with the system of FIG. 1 is that it requires a large number of tanks, pumps, mixers, valves, instrumentation, etc., all of which add cost, complexity, and energy consumption to the manufacture, operation, and maintenance of the system.

A further problem with the system of FIG. 1 is that it relies on gravity separation which is inherently slow and inefficient, and still leaves appreciable amounts of contaminants in the purified solution stream flowing back to the flux bath. It also relies on the addition of polymers to settle the suspended solids which, in turn, necessitates the addition of one more tank and mixer to the system.

DETAILED DESCRIPTION

The inventive principles of this patent disclosure are directed to multiple improvements in systems for removing contaminants from a galvanizing flux solution. Each of these principles has individual utility and benefits. When combined, however, the inventive principles enable the realization of a comprehensive system in which the individual elements interact in novel ways to provide synergistic results.

Some of the improvements relate to the application of alternative known elements from other fields to systems for the purification of galvanizing flux. However, the conventional techniques for using these known elements may present additional problems or produce unsatisfactory results when applied to flux recovery. Therefore, some additional inventive principles of this patent disclosure are directed to techniques for adapting alternative known elements in novel ways to achieve new and beneficial results.

Some inventive principles of this patent disclosure relate to techniques for using ozone to selectively precipitate contaminants in a galvanizing flux solution. Ozone is an excellent alternative to hydrogen peroxide because it is much safer to work with while still being a strong oxidizer. It has a relatively short "half-life" of about 30 minutes, and because it does not contain any water, it does not dilute the chemistry of the flux solution.

Figure 1:
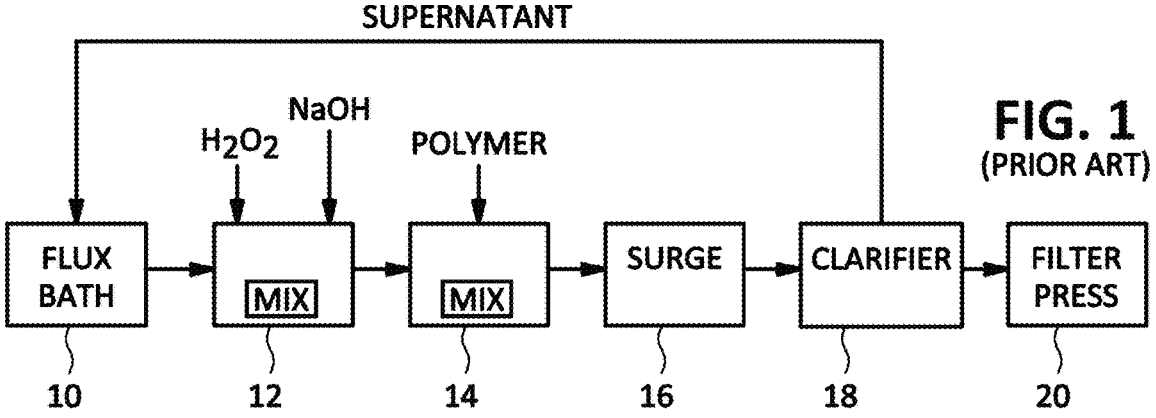
FIG. 1 (PRIOR ART)
FIG. 1 illustrates a prior art system for using hydrogen peroxide to remove contaminants from a galvanizing flux bath.
Figure 2:
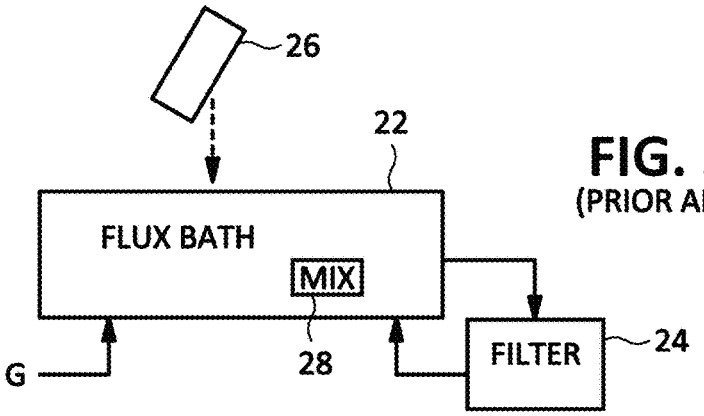
FIG. 2 (PRIOR ART)
FIG. 2 illustrates a prior art system for using ozone to remove contaminants from a galvanizing flux bath.

Prior attempts to use ozone to recover galvanizing flux, however, have produced unsatisfactory results. For example, FIG. 2 illustrates a system disclosed in U.S. Patent Application Publication No. 2014/0158544 which teaches injecting an oxygen-rich gas G such as ozone directly into the bottom of a flux tank 22 into which steel parts 26 are dipped. The resulting gas bubbles float upward and react with iron ions in the flux solution, aided by a mixing device 28 such as a stirring rod. A multi-layer filter 24, which appears to be a dead-end type filter, is used to remove precipitated iron from the flux solution.

The system of FIG. 2, however, severely limits the amount of ozone that may be added to the flux tank because the flow rate must be kept low enough to assure that all of the ozone is consumed before the bubbles reach the surface. Otherwise, unreacted ozone will escape from the solution, thereby wasting ozone and creating potentially hazardous conditions around the tank. The flow rate is further limited by the fact that relying on the gravity driven motion of bubbles, with their accompanying surface tension, results in poor mixing of ozone with contaminants, thereby limiting the rate of reaction. Moreover, having bubbles floating upward through the dip tank may interfere with the fluxing process. A further problem with the system of FIG. 2 is that the use of a dead-end filter is cumbersome and labor-intensive because the filter media typically needs to be changed frequently.

Some improved techniques for using ozone to remove contaminants from a galvanizing flux solution according to the inventive principles of this patent disclosure are described below.

Some additional inventive principles of this patent disclosure relate to techniques for adapting cross-flow microfiltration apparatus to remove contaminants from a galvanizing flux solution. In a cross-flow filter (also referred to as a tangential-flow filter) most of the fluid flows across the face of the filter media rather than through the media. Only a relatively small amount of fluid, referred to as permeate, flows through the filter media and exits as filtered liquid. The remainder of the fluid, referred to as retentate, exits the filter structure after flowing across the face of the filter media. This mode of operation is especially useful for microfilters which have filter media (often a polymer membrane) with very small pores. If a microfilter is operated in a dead-end mode in which all of the fluid attempts to pass through the filter media, the media quickly becomes clogged with particles and requires frequent time-consuming and labor-intensive back flushing, cleaning, or replacement. By operating in a cross-flow mode however, particles that are too large to pass through the filter media are quickly swept away by the continuous flow of fluid across the face of the media, rather than building up on the media.

Figure 3:
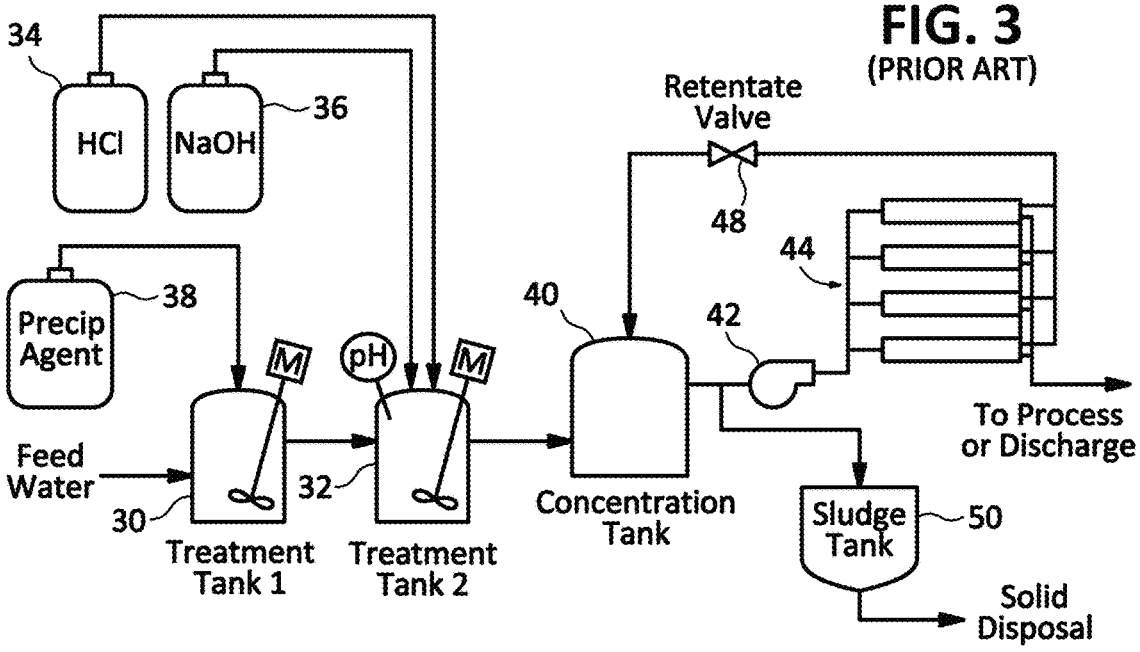
FIG. 3 (PRIOR ART)
FIG. 3 illustrates a prior art system for using cross-flow microfiltration to remove metallic contaminants from a waste stream.

FIG. 3 illustrates a conventional cross-flow microfiltration system for precipitating and removing metals from a wastewater stream. The system of FIG. 3 includes two reaction tanks arranged in series. Wastewater is fed into the first reaction tank 30 where it is mixed with precipitation agents 38 to cause metals to precipitate out of solution. The water is then transferred to the second reaction tank 32 where the pH is adjusted through the addition of hydrochloric acid 34 or sodium hydroxide 36 to enhance the precipitation and formation of solids. The waste stream is then directed to a concentration tank 40 where it is repeatedly pumped through a filter train of cross-flow microfiltration modules 44 under the motive force of circulation pump 42. The retentate, including the solids, is returned to the concentration tank 40, while permeate, from which the solids have been removed by filter media in the microfiltration modules 44, is discharged as treated water. As the clean, treated water leaves the concentration loop, additional wastewater is admitted to the concentration tank 40, and the retained solids in the loop become increasingly concentrated. Excess solids are removed from the loop by diverting some of the wastewater from the concentration loop to a sludge tank 50.

To achieve proper filtration, a differential pressure must be maintained across the filter media in the microfiltration modules. That is, there must be a higher pressure on the inside of the filter media than the outside (permeate side). This is accomplished by the use of a retentate valve 48 which restricts the flow of solution, thereby allowing the circulation pump 42 to build up adequate pressure in the microfiltration modules 44.

The prior art system of FIG. 3 suffers from multiple unnecessary complexities and inefficiencies. For example, motive forces are applied to the fluids by mixers M in both treatment tanks, as well as by the circulation pump 42 in the concentration loop. This increases the power consumption of the system, and also increases the cost to manufacture, operate, and maintain the system. Moreover, much of the energy consumed by the circulation pump 42 is wasted in the form of the pressure drop across the retentate valve 48 which does not produce any useful work. The use of multiple treatment tanks 30 and 32, in addition to the concentration tank 40, increases the cost to manufacture, operate, and maintain the system, and also consumes valuable floor space.

Figure 4:
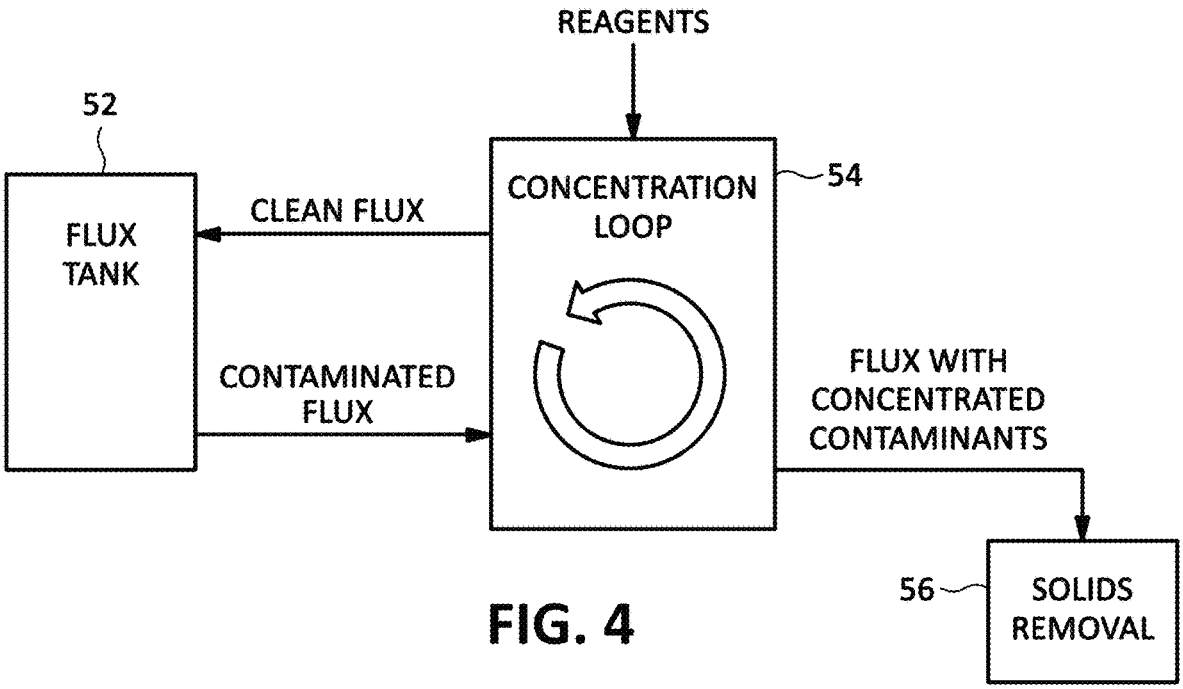
FIG. 4 is a block diagram of an embodiment of a system for removing contaminants from galvanizing flux solution according to the inventive principles of this patent disclosure.

FIG. 4 is a block diagram of an embodiment of a system for removing contaminants from galvanizing flux solution according to the inventive principles of this patent disclosure. The system of FIG. 4 includes a concentration loop 54 that receives contaminated flux solution from a galvanizing flux tank 52 and returns clean flux to the tank. Flux with concentrated contaminants exits the concentration loop 54 for further processing by solid removal apparatus 56.

The concentration loop 54 includes a filtration system having one or more cross-flow microfiltration modules and a pump or other source of motive force to propel the flux through the modules. The concentration loop 54 may also include various other components such as one or more tanks, mixers, control and instrumentation devices, etc., depending on the specific implementation.

An important aspect of the embodiment of FIG. 4 is that one or more reagents are added directly to the concentration loop. Examples of reagents include: oxidizers such as hydrogen peroxide, air, ozone, chlorine, permanganate, etc.; chemicals to control pH; chemicals to convert sulfates and other byproducts of pickling operations to insoluble forms; and any other chemicals to facilitate removal of contaminants from the galvanizing flux solution.

An advantage of adding reagents directly to the concentration loop 54 is that it may reduce the number of components in the system, thereby reducing the cost of manufacturing, operating and maintaining the system. Another advantage is that it may reduce energy consumption by utilizing the motive force already present in the concentration loop to facilitate mixing, chemical injection, etc. A further advantage is that it may provide better performance in the form of faster reaction rates, more uniform mixing, etc.

Figure 5:
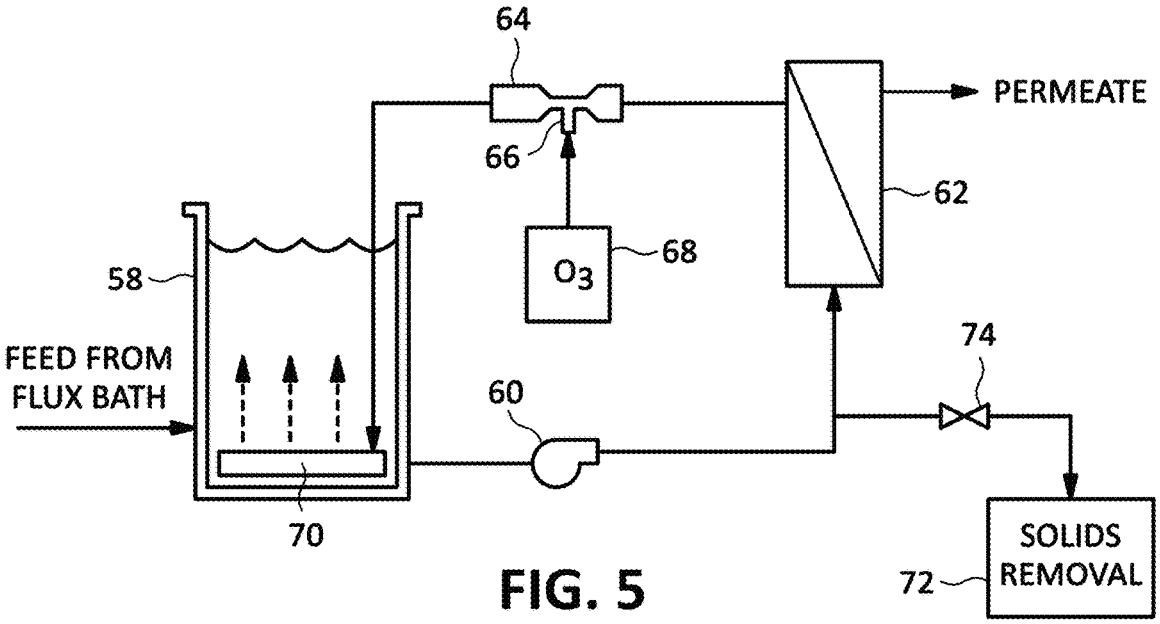
FIG. 5 is a flow diagram of an embodiment of a system for removing contaminants from a galvanizing flux solution according to the inventive principles of this patent disclosure.

FIG. 5 is a flow diagram of an embodiment of a system for removing contaminants from a galvanizing flux solution according to the inventive principles of this patent disclosure. The embodiment of FIG. 5 includes a concentration tank 58 that receives contaminated flux from a galvanizing flux bath. A circulation pump 60 pump draws flux from the concentration tank 58 and pumps the flux through an arrangement of one or more microfiltration modules 62. Rather than using a retentate valve as in the prior art, the system of FIG. 5 includes an eductor 64 that restricts the flow of retentate out of the microfiltration modules 62, thereby enabling the circulation pump 60 to develop adequate operating pressure across the filter media of the modules. The pressure causes clean flux to flow through the filter media which prevents the passage of insoluble matter and allows the passage of the permeate (clean flux) which is returned to the galvanizing flux bath. The permeate includes dissolved zinc ammonium chloride which is a valuable constituent of the flux solution.

The flow of retentate through the eductor 64 under the motive force of the circulation pump 60 creates a pressure differential across the eductor 64 which, due to the venturi effect, reduces the pressure at the suction port 66 of the eductor, thereby causing the eductor to draw ozone gas from an ozone generator 68 into the retentate stream. The retentate leaves the eductor 64 at a reduced pressure and is returned to the concentration tank 58 through a diffuser 70 at the bottom of the tank, thereby completing a concentration loop which includes the tank 58, the circulation pump 60, the microfiltration modules 62, and the eductor 64.

The eductor 64 creates ideal conditions for drawing ozone into the concentration loop and mixing it with the flux. The eductor 64 includes an orifice that constricts the flow of flux to a high-velocity stream into which the gaseous ozone is drawn. The ozone gas begins mixing and reacting with the flux in the high-velocity stream and continues mixing and reacting as the stream enters a lower pressure section of the eductor body. Agitation, turbulent flow, and additional mixing and reaction continue as the flux flows through the piping that connects the eductor 64 to the concentration tank 58. During the mixing and reacting, ozone reacts with soluble Ferrous ($Fe^{+2}$) ions to form insoluble Ferric ($Fe^{+3}$) Hydroxide solids which are unable to pass through the microfilter membranes on subsequent passes through the concentration loop. As one example, this may be accomplished with a tubular membrane microfilter module having a pore size of 0.05 microns (μm).

Depending on the implementation details, essentially all of the ozone may have reacted before it reaches the bottom of the concentration tank 58. Alternatively, some unreacted ozone may remain in the fluid stream which is then allowed to enter the bottom of the concentration tank 58 through orifices in the diffuser 70 that provide a flow of liquid and, when present, ozone gas upward through the tank to complete the reaction.

The ozone generator 68 may be controlled by an oxidation reduction potential (ORP) controller that turns the generator on and off in response to a signal from an ORP sensor located in the concentration tank 58 or other suitable location in the concentration loop. As an example, the controller may be programmed to maintain the ORP at slightly above 200 mV.

When the concentration of solids in the concentration loop reaches a suitable level, some of the flux is transferred to solids removal apparatus 72 through a valve 74. The solids removal apparatus 72 may include a clarifier-thickener tank and/or a filter press. Supernatant from a clarifier-thickener and/or filtrate from a filter press may be returned to the concentration tank 58, while solids or sludge may be disposed of in an appropriate manner. The concentration tank 58 is continuously refilled with more contaminated flux to make up for flux that leaves the loop in the form of clean flux that is returned to the flux bath as permeate from the microfiltration modules 62, and flux that is transferred to the solids removal apparatus 72.

The orifices in the diffuser 70 may be sized and arranged and coordinated with the flow rate through the loop to provide different flow dynamics in the concentration tank 58. For example, in some applications, the orifices may be relatively large and oriented directly upward to produce a low discharge velocity and allow any unreacted ozone to float gently upward as it finishes reacting with the flux.

In other applications, however, especially where all of the ozone is consumed before reaching the diffuser, smaller orifices may be oriented in directions that create more turbulence to facilitate mixing of other reagents such as barium chloride ($BaCl_2$) dihydrate salt which may be added manually to the concentration tank 58 in predetermined scoops to remove sulfates carried through the rinse tanks and into the flux tank of a galvanizing operation that uses sulfuric acid instead of hydrochloric acid during the pickling step. The soluble barium chloride reacts with sulfate molecules to form insoluble barium sulfate ($BaSO_4$) which becomes concentrated in the loop and is eventually eliminated through the solids removal apparatus 72.

In yet other applications, the orifices in the diffuser 70 may be sized and arranged to provide an intermediate amount of turbulence and agitation.

The embodiment illustrated in FIG. 5 provides a simple, compact, tightly integrated system with significant advantages over prior art systems. For example, the power consumption of the system may be reduced because some of the power applied to the circulation pump 60 to create the motive force through the microfiltration modules 62 is essentially recycled and reused in the eductor 64, piping, and concentration tank 58. This recycled energy provides mixing forces that may otherwise require a separate mixer in the concentration tank 58 along with its associated cost, complexity, energy consumption, and reliability issues.

Another advantage of the system of FIG. 5 is that it may provide better performance due to the fast mixing and reaction of ozone and flux in the eductor 64 and associated piping. This is in comparison to prior art systems in which ozone is only combined with flux through a diffuser in the bottom of a tank. In such systems, the flow of ozone is severely limited because it must be kept low enough that all of the ozone reacts before it floats to the top of the tank. Otherwise, excess ozone will be wasted and escape from the tank, possibly causing hazardous conditions.

The embodiment of FIG. 5 may be modified in various way according to the inventive principles of this patent disclosure. For example, depending on the application, the diffuser may be eliminated and the retentate flow from the eductor maybe piped directly into the concentration tank. In other applications, the piping loop may include enough volume that the concentration tank may be eliminated. As further examples, the type and number of microfilter modules may be changed, valves and pipes may be added in series or parallel with the eductor to modify the or supplement the flow through the eductor and vary the flow and pressure in the modules, etc.

The eductor may be moved to a different location in the loop, or it may be replaced or supplemented by one or more additional eductors. In some embodiments, the eductor may be replaced or supplemented by other apparatus that provide adequate operating pressure across the filter medium and inject the oxidizer into the concentration loop. For example, a retentate valve may be used to create the operating pressure across the filter medium, while the oxidizer may be injected into the loop through a suitable injection port anywhere in the loop. The oxidizer may be pressurized to an operating pressure sufficient to overcome the liquid pressure at the point in the loop where it is injected. Examples of injection ports are gas injection nozzles and gas diffusion stones. Parallel or serial combinations of any of the above described apparatus may also be utilized.

Although the embodiments of FIGS. 4 and 5 have been described in the context of systems for removing contaminants from galvanizing flux solutions, they may also be applied to any treatment apparatus in which soluble contaminants in a solution can be converted to insoluble forms through introduction of a reagent and removed from the solution by concentrating the solids in a loop with microfilters.

Figure 6:
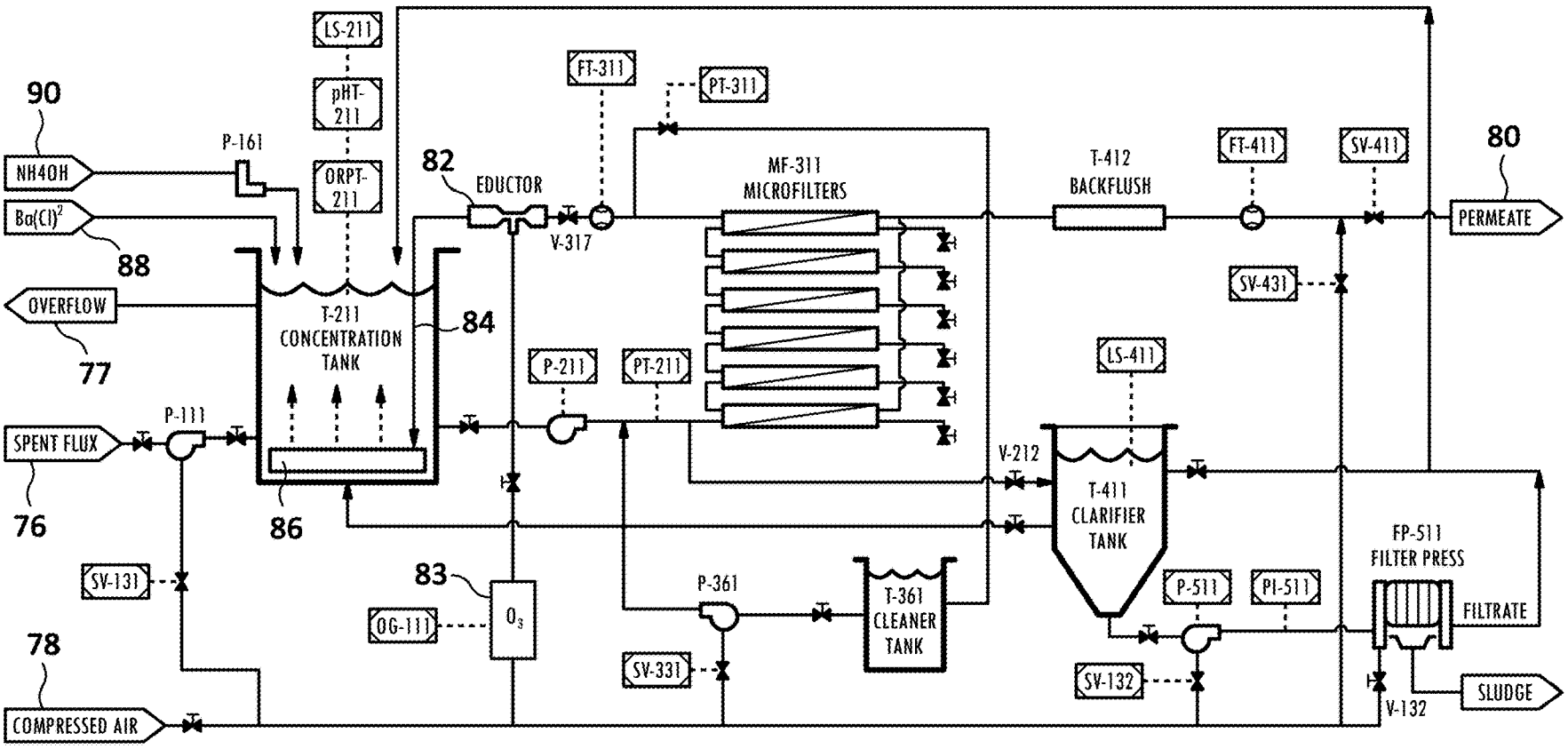
FIG. 6 is a piping and instrumentation diagram of an embodiment of a system for removing contaminants from a galvanizing flux solution according to the inventive principles of this patent disclosure.

FIG. 6 is a piping and instrumentation diagram (P&ID) of an embodiment of a system for removing contaminants from a galvanizing flux solution according to the inventive principles of this patent disclosure. Some implementation details and numerical values will be provided by way of example in the description of the embodiment of FIG. 6 to help provide a more thorough understanding of the operation of the system. However, the inventive principles are not limited to these example details and values.

The system of FIG. 6 includes a concentration tank, also referred to as a mix tank, T-211 which in this example embodiment may be a cylindrical or cone-bottom polyethylene tank in the range of 50-100 gallons. Contaminated flux solution 76 is pumped from the flux bath into the concentration tank by a feed pump which in this example is an air operated centrifugal pump P-111 powered by compressed air supply 78. The feed pump P-111 is controlled by a central controller through automatic control valve SV-131 in response to a signal from a level sensor LS-211 in the tank to maintain a constant fluid level in the tank. The feed pump may need to transfer more flux to the concentration tank, for example, to make up for clean flux (permeate 80) that is returned to the flux bath, and to make up for flux with concentrated solids that is transferred to the clarifier-thickener tank T-411. An overflow port 77 returns flux back to the flux bath in the event the concentration tank becomes overfilled.

The central controller controls the operation of the entire system and may be embodied in a control panel mounted in a NEMA 4X box with a central processing unit (CPU), analog cards, RTD cards, DC cards, a data highway, a 24 volt power supply, contactors, motor starters, fuses, SMC solenoids, and wire cables. The panel receives analog and digital inputs from multiple points in the system including the level sensor, pressure transmitters, and flow transmitters. It sends analog and digital outputs to the pumps, valves, and speed controllers on the system. The software platform by Rockwell Automation is customized to fit the application. The software has a human machine interface (HMI) which may be either a panel-mount display device or a computer, keyboard, and monitor.

Circulation pump P-211 provides the motive force for the concentration loop which includes a train MF-311 of six series-connected microfilter modules which in this example are model MME3S05601VC tubular crossflow modules with polyethylene membranes having a pore size of 0.05 microns (μm). The permeate outputs of all six modules are connected in parallel to provide the permeate output port 80 back to the flux bath. The modules are mounted on a rack with most of the other system components other than the concentration tank.

The retentate output of the final microfilter module is connected to the main input of eductor 82 which in this example is a Mazzei model 1584-A injector. An additional flow control valve is connected in series between the eductor and filter modules to provide fine-tuning of the pressure in the microfilter modules if needed, and also for service and maintenance purposes. The orifice of the eductor is sized to maintain a pressure of 60 pounds per square inch (psi) in the filter modules when the flow rate into the input of the first filter module is 60 gallons per minute (gpm). Thus, the circulation pump, which in this example is a centrifugal pump, is sized to provide 60 gpm flow at 60 psi head pressure. The flow rate through the main input to the eductor, however is lower than 60 gpm because some of the flux solution entering the module train leaves the concentration loop as clean permeate. In this example, the filter modules are sized to provide a permeate flow rate of about 3-4 gpm back to the flux bath. Thus, the feed pump P-111 typically transfers about 3-4 gpm of contaminated flux from the flux bath to the concentration tank during normal operation. A flow rate of 60 gpm translates to a flow velocity of about 15 feet per second (fps) at the input to the first filter module. This drops gradually as the flux flows through the filter train and permeate is removed from the loop, but it remains above the minimum required for adequate scrubbing of the membrane walls to prevent excessive clogging of the membranes between backflush cycles.

The suction input of the eductor 82 is connected to an ozone generator 83 which is fed by compressed air supply 78. The output of the eductor 82 flows to the bottom of the concentration tank through a section of pipe 84 where it is released into the tank through a diffuser 86 which is a ring of pipe having orifices distributed around the ring. As discussed above, the eductor creates a mixing effect through agitation and turbulence that continue through the section of pipe 84 and into the diffuser 86. It is believed that about 80 percent of the ozone is reacted with ferrous (Fe+2) iron in the first contact with the flux solution in the eductor and piping before it leaves the diffuser. The second contact between ozone and flux occurs in the concentration tank where the ozone quells the tank and provides mild agitation. By careful selection of the tank size, piping, and orifices, a flow distribution and velocity may be obtained to provide mild agitation and a percolation effect such that there is enough contact between ozone and flux to complete the final 20 percent of the reaction without the need for a mixer in the tank.

The central controller controls the ozone generator in response to a signal from an oxidation reduction potential (ORP) transducer ORPT-211 located in the concentration tank to maintain the ORP at a minimum of about 200 mV or slightly higher. This provides just the right amount of ozone for complete conversion of ferrous (Fe+2) iron to ferric (Fe+3) hydroxide without wasting ozone or allowing it to escape from the concentration tank.

The ozone generator 83 can be implemented with any suitable commercially available system. For example, in some ozone generators, oxygen is produced from a PSA oxygen concentrator and fed through an electric arc reactor that breaks the oxygen from 3 oxygen molecules ($O_2$) into 2 very highly oxidative ozone molecules ($O_3$).

During times when the ozone generator is off, the eductor simply draws air into the flux stream. Although the oxygen in air is much less reactive than ozone, it still provides some oxidizing effect, thereby taking some additional advantage of the motive force of the circulator pump.

The central controller monitors the operation of the concentration loop through signals from pressure transmitters PT-211 and PT-311 and flow transmitter FT-311.

As an example, contaminated incoming flux solution may typically contain suspended solids at 250 mg/l. When the microfiltration system has completed its cycle, the flux permeate (filtered product) will be essentially solids free and the suspended solids in the recirculating concentrate should be as high as 5% (50,000 mg/liter). For every 1,000 gallons of contaminated flux solution fed to the process, only 5 gallons of high solids solution remains. That is a 200:1 concentration ratio.

When the concentration of solids in the flux solution in the concentration loop is determined to reach a level of about 5 percent, either through automatic sensing or manually with a graduated cylinder, some of the flux solution is transferred to the clarifier thickener tank T-411 by opening valve V-212. After the solids are allowed to settle in the tank, they are pumped to the filter press FP-511 by another air operated diaphragm pump P-511 using compressed air supply 78 under control of valve SV-132. The filter press is also operated using compressed air supply 78 under control of valve V-132. Supernatant from the clarifier thickener tank and filtrate from the filter press are returned to the concentration tank, while solids or sludge from the filter press are sent for disposal.

The system automatically goes through a 30 second back pulse operation every 15 minutes using backflush tank T-412 to clear the membranes of any built up solids. Every week the membranes may be chemically cleaned in 5% HCl for about 1 to 4 hours to restore the membrane performance to the original specifications. The leachate from this cleaning is simply added back into the concentration tank.

Some of the various operations described above may be monitored and/or controlled by the central controller through the following sensors and control devices: flow transmitter FT-411, valves SV-411, SV-431, SV-331 and SV-132, and level sensor LS-411. Various other valves located throughout the system are used for service, maintenance and manual operations.

In galvanizing applications where sulfuric acid is used for the pickling step, barium chloride ($BaCl_2$) dihydrate salt maybe manually added to the concentration tank in predetermined scoops to remove sulfates carried through the rinse tanks and into the flux. The soluble barium chloride reacts with the sulfate molecules to produce an insoluble barium sulfate ($BaSO_4$) solid that is filterable. The reaction is very quick and complete.

The system of FIG. 6 may optionally include a source 90 of ammonium hydroxide ($NH_4OH$) which may be added to the concentration tank through chemical pump P-161 under control of the central control in response to a signal from a pH transmitter pHT-211 in the tank. This may be used to control the pH in the concentration loop.

Some additional inventive principles of this patent disclosure relate to the recognition that, in most galvanizing operations, the pH of the zinc ammonium chloride solution in the flux tank must be adequately controlled for the fluxing step to perform properly. Most prior art flux purification systems attempt to control the pH in the treatment or concentration tanks because a pH of about 4.5 is generally considered to be an optimal point for ferric hydroxide formation, although a range of about 4.2 to about 5.0 can be used without significant degradation in system performance. Attempting to control the pH in the concentration loop, however, may be an unnecessarily difficult task because a typical galvanizing flux bath tank may have a capacity of 15,000 to 20,000 gallons, while the concentration tank may have a capacity of only 50 to 100 gallons. Thus, any adjustments to the pH in the concentration tank may be quickly overwhelmed by the continuous inflow of flux solution from the flux tank. Since the operator of the galvanizing operation typically maintains the pH of the flux tank at about 5.0, it may be advantageous to save the adjustment chemicals and simply run the concentration loop at the same pH as the incoming flux solution. This contributes to further simplification of the system which, as mentioned above, is one of the benefits of the inventive principles.

Since the inventive principles of this patent disclosure can be modified in arrangement and detail without departing from the inventive concepts, such changes and modifications are considered to fall within the scope of the following claims.

The invention claimed is:

1. A system for removing contaminants from a solution in a treatment apparatus, the system comprising:

a concentration loop having an input to receive contaminated solution from the treatment apparatus and an output to return purified solution to the treatment apparatus, the concentration loop comprising:

a circulation pump having an input and an output;

a cross-flow microfilter having an input, a retentate output, and a permeate output, wherein the input of the microfilter is coupled to the output of the circulation pump, and the permeate output of the microfilter is coupled to the output of the concentration loop; and an eductor having a main input, a suction input, and an output, wherein the main input of the eductor is coupled to the retentate output of the microfilter;

wherein:

the concentration loop further comprises a concentration tank having an output port coupled to the input of the circulation pump;

the output of the eductor is arranged to return retentate to the concentration tank; and the concentration loop further comprises a diffuser located in the concentration tank and coupled to the output of the eductor.

2. A system for removing contaminants from a solution in a treatment apparatus, the system comprising:

a concentration loop having an input to receive contaminated solution from the treatment apparatus and an output to return purified solution to the treatment apparatus, the concentration loop comprising:

a circulation pump having an input and an output;

a cross-flow microfilter having an input, a retentate output, and a permeate output, wherein the input of the microfilter is coupled to the output of the circulation pump, and the permeate output of the microfilter is coupled to the output of the concentration loop; and an eductor having a main input, a suction input, and an output, wherein the main input of the eductor is coupled to the retentate output of the microfilter; and a solids removal apparatus coupled to the concentration loop;

wherein the solids removal apparatus is arranged to return purified solution to the concentration loop.

* * * * *